US010713869B2

(12) United States Patent
Morris et al.

(10) Patent No.: US 10,713,869 B2
(45) Date of Patent: Jul. 14, 2020

(54) SYSTEM FOR FACILITATING ACCESS TO A SECURED AREA

(71) Applicant: The Chamberlain Group, Inc., Oak Brook, IL (US)

(72) Inventors: David R. Morris, Glenview, IL (US); James Scott Murray, Glendale Heights, IL (US); Robert J. Olmsted, Wood Dale, IL (US)

(73) Assignee: The Chamberlain Group, Inc., Oak Brook, IL (US)

( * ) Notice: Subject to any disclaimer, the term of this patent is extended or adjusted under 35 U.S.C. 154(b) by 0 days.

(21) Appl. No.: 16/050,923

(22) Filed: Jul. 31, 2018

(65) Prior Publication Data

US 2019/0043290 A1 Feb. 7, 2019

Related U.S. Application Data

(60) Provisional application No. 62/540,047, filed on Aug. 1, 2017, provisional application No. 62/659,535, filed on Apr. 18, 2018.

(51) Int. Cl.

| | |
|---|---|
| ***E05F 15/668*** | (2015.01) |
| ***E05F 15/77*** | (2015.01) |
| ***G07C 9/00*** | (2020.01) |

(52) U.S. Cl.

CPC ..... *G07C 9/00309* (2013.01); *E05F 15/668* (2015.01); *E05F 15/77* (2015.01);

(Continued)

(58) Field of Classification Search

None

See application file for complete search history.

(56) References Cited

U.S. PATENT DOCUMENTS

| | | | |
|---|---|---|---|
| 1,008,980 | A | 11/1911 | Mills |
| 5,285,205 | A | 2/1994 | White |

(Continued)

FOREIGN PATENT DOCUMENTS

| | | |
|---|---|---|
| AT | 501039 | 5/2006 |
| AT | 008481 | 8/2006 |

(Continued)

OTHER PUBLICATIONS

PCT Patent Application No. PCT/US2018/044625; International Search Report and Written Opinion dated Nov. 18, 2018; 12 Pages.

(Continued)

*Primary Examiner* — Steven Lim
*Assistant Examiner* — Muhammad Adnan
(74) *Attorney, Agent, or Firm* — Fitch, Even, Tabin & Flannery LLP

(57) ABSTRACT

A movable barrier operator comprising a motor, communication circuitry configured to receive a control signal and communicate with a door lock associated with a passageway door, and a controller. The controller is configured to authenticate the control signal, wherein authenticating the control signal includes associating the signal with a first level of access or a second level of access. The controller is further configured to communicate with the door lock via the communication circuitry to permit opening of the passageway door in response to associating the control signal with the first level of access and inhibit opening of the passageway door in response to associating the control signal with the second level of access. The controller is configured to cause the motor to open the movable barrier regardless of association of the control signal with the first level of access or the second level of access.

20 Claims, 9 Drawing Sheets

(52) U.S. Cl.
CPC ..... *G07C 9/00896* (2013.01); *E05Y 2201/22* (2013.01); *E05Y 2400/81* (2013.01); *E05Y 2400/814* (2013.01); *E05Y 2400/818* (2013.01); *E05Y 2900/106* (2013.01); *G07C 2009/00928* (2013.01)

(56) References Cited

U.S. PATENT DOCUMENTS 5,774,053 A * 6/1998 Porter ..... A47G 29/141 232/19
6,134,593 A 10/2000 Alexander
6,204,763 B1 3/2001 Sone
6,300,873 B1 10/2001 Kucharczyk
6,529,949 B1 3/2003 Getsin
6,563,431 B1 * 5/2003 Miller, Jr. ..... E04H 6/426 340/330
6,570,488 B2 5/2003 Kucharczyk
6,574,455 B2 6/2003 Jakobsson
6,696,918 B2 2/2004 Kucharczyk
6,793,253 B2 9/2004 Bruwer
6,853,853 B1 2/2005 Van Wiemeersch
6,909,356 B2 6/2005 Brown
6,950,725 B2 9/2005 Von Kannewurff
6,952,181 B2 10/2005 Karr
6,965,294 B1 11/2005 Elliott
6,967,562 B2 11/2005 Menard
6,987,452 B2 1/2006 Yang
7,035,916 B1 4/2006 Backman
7,120,697 B2 10/2006 Aiken, Jr.
7,149,959 B1 12/2006 Jones
7,170,998 B2 1/2007 McLintock
7,193,644 B2 3/2007 Carter
7,205,908 B2 4/2007 Tsui
7,212,889 B2 5/2007 Mann
7,237,013 B2 6/2007 Winkeler
7,260,835 B2 8/2007 Bajikar
7,269,634 B2 9/2007 Getsin
7,379,805 B2 5/2008 Olsen, III
7,553,173 B2 6/2009 Kowalick
7,653,603 B1 1/2010 Holtkamp, Jr.
7,735,732 B2 6/2010 Linton
7,746,223 B2 6/2010 Howarter
7,786,891 B2 8/2010 Owens
7,788,221 B2 8/2010 Tanaka
7,847,675 B1 12/2010 Thyen
8,018,329 B2 9/2011 Morgan
8,044,782 B2 10/2011 Saban
8,045,961 B2 10/2011 Ayed
8,077,054 B1 12/2011 Aarons
8,093,986 B2 1/2012 Harvey
9,208,629 B2 * 12/2015 Saladin ..... G07C 9/00896
9,322,194 B2 4/2016 Cheng
9,322,201 B1 4/2016 Cheng
9,326,094 B2 4/2016 Johnson
9,359,794 B2 6/2016 Cheng
9,382,739 B1 7/2016 Johnson
9,447,609 B2 9/2016 Johnson
9,470,018 B1 10/2016 Cheng
9,530,262 B2 12/2016 Johnson
9,530,295 B2 12/2016 Johnson
9,644,399 B2 5/2017 Johnson
9,647,996 B2 5/2017 Johnson
9,652,917 B2 5/2017 Johnson
9,683,391 B2 6/2017 Johnson
9,704,320 B2 7/2017 Johnson
9,727,328 B2 8/2017 Johnson
9,756,233 B2 9/2017 Lee
9,779,571 B2 10/2017 Chong
9,786,141 B2 * 10/2017 Grabham ..... G08B 13/1472
9,835,434 B1 * 12/2017 Sloo ..... G06K 7/081
9,916,746 B2 3/2018 Johnson
9,977,547 B1 * 5/2018 Sloo ..... G06F 3/044
10,015,898 B2 * 7/2018 Whitmire ..... G07C 9/00896
10,089,801 B1 * 10/2018 Musabeyoglu .... G07C 9/00007
10,147,249 B1 * 12/2018 Brady ..... G07C 9/00174
10,167,661 B2 * 1/2019 Preus ..... E05F 15/79
10,332,383 B1 * 6/2019 Giles ..... G08B 13/08
10,382,608 B2 * 8/2019 Gerhardt ..... H04M 1/72533
10,388,092 B1 * 8/2019 Solh ..... G06K 9/00255
10,540,884 B1 * 1/2020 Lyman ..... G08B 13/22
2001/0040422 A1 * 11/2001 Gramlich ..... A47G 29/141 312/234
2002/0035857 A1 3/2002 Stein
2002/0053975 A1 * 5/2002 Fitzgibbon ..... G07C 9/00182 340/541
2002/0087429 A1 * 7/2002 Shuster ..... G06Q 10/08 340/5.73
2002/0147919 A1 10/2002 Gentry
2002/0152390 A1 10/2002 Furuyama
2002/0177460 A1 11/2002 Beasley
2002/0180582 A1 12/2002 Nielsen
2003/0007851 A1 1/2003 Heigl
2004/0057567 A1 3/2004 Lee
2004/0066328 A1 4/2004 Galley
2004/0168083 A1 8/2004 Gasparini
2005/0006908 A1 1/2005 Bruwer
2005/0060063 A1 3/2005 Reichelt
2005/0080898 A1 4/2005 Block
2005/0149741 A1 7/2005 Humbel
2005/0172462 A1 8/2005 Rudduck
2005/0199019 A1 9/2005 Marcelle
2005/0204787 A1 9/2005 Ernst
2005/0207616 A1 * 9/2005 Brad ..... G01V 8/12 382/103
2006/0058012 A1 3/2006 Caspi
2006/0170533 A1 8/2006 Chioiu
2006/0176016 A1 8/2006 Kok
2006/0190419 A1 8/2006 Bunn
2006/0202815 A1 9/2006 John
2006/0255912 A1 11/2006 Simms
2007/0008142 A1 * 1/2007 Crowe ..... A45C 11/32 340/572.8
2007/0022438 A1 1/2007 Arseneau
2007/0193834 A1 8/2007 Pai
2008/0072170 A1 3/2008 Simons
2008/0168271 A1 7/2008 Sherburne
2008/0247345 A1 10/2008 Bahar
2008/0298230 A1 12/2008 Luft
2009/0037217 A1 2/2009 Naik
2009/0209829 A1 * 8/2009 Yanagidaira ..... A61B 5/165 600/301
2009/0231093 A1 9/2009 Keller, Jr.
2010/0075655 A1 3/2010 Howarter
2010/0176919 A1 7/2010 Myers
2010/0201536 A1 8/2010 Robertson
2010/0250929 A1 9/2010 Schultz
2010/0283560 A1 11/2010 Sommer
2010/0283580 A1 11/2010 Sheng
2010/0306549 A1 12/2010 Ullmann
2011/0060480 A1 3/2011 Mottla
2011/0106329 A1 5/2011 Donnelly
2011/0165896 A1 7/2011 Stromberg
2011/0166700 A1 7/2011 Dunn
2011/0187497 A1 8/2011 Chin
2011/0227712 A1 9/2011 Atteck
2011/0231914 A1 9/2011 Hung
2011/0252843 A1 10/2011 Sumcad
2011/0311052 A1 12/2011 Myers
2012/0007735 A1 1/2012 Rhyins
2012/0092124 A1 * 4/2012 Fitzgibbon ..... H04B 1/713 340/5.1
2012/0092125 A1 * 4/2012 Farber ..... G07C 9/00111 340/5.7
2012/0280783 A1 * 11/2012 Gerhardt ..... G07C 9/00309 340/5.6
2012/0280789 A1 11/2012 Gerhardt
2012/0280790 A1 11/2012 Gerhardt
2014/0180959 A1 * 6/2014 Gillen ..... G06Q 10/0833 705/341
2014/0365773 A1 12/2014 Gerhardt
2015/0102906 A1 4/2015 Gerhardt
2015/0154461 A1 * 6/2015 Kitaura ..... G06K 9/00845 348/148

(56) References Cited

U.S. PATENT DOCUMENTS

| | | | | |
|---|---|---|---|---|
| 2015/0179011 | A1 | 6/2015 | Kramer | |
| 2015/0181014 | A1 | 6/2015 | Gerhardt | |
| 2015/0221147 | A1* | 8/2015 | Daniel-Wayman | G07C 9/00103 340/5.54 |
| 2015/0235172 | A1* | 8/2015 | Hall | G06Q 10/0833 705/333 |
| 2015/0281658 | A1* | 10/2015 | Lee | H04N 5/23203 348/211.1 |
| 2015/0310381 | A1* | 10/2015 | Lyman | G06Q 10/083 705/330 |
| 2016/0247344 | A1* | 8/2016 | Eichenblatt | A47G 29/141 |
| 2016/0258777 | A1* | 9/2016 | Bodake | G01C 21/367 |
| 2017/0099295 | A1 | 4/2017 | Ricci | |
| 2018/0075681 | A1* | 3/2018 | Scalisi | H04L 67/125 |
| 2018/0191889 | A1 | 7/2018 | Gerhardt | |
| 2018/0276613 | A1* | 9/2018 | Hall | G06Q 10/0833 |
| 2019/0034859 | A1* | 1/2019 | Kim | G07C 9/00571 |
| 2019/0035187 | A1* | 1/2019 | Kim | G07C 9/00182 |

FOREIGN PATENT DOCUMENTS

| | | | |
|---|---|---|---|
| AT | 008482 | | 8/2006 |
| CN | 101329779 | | 12/2008 |
| CN | 101329779 | A | 12/2008 |
| CN | 103635940 | | 3/2014 |
| CN | 103635940 | A | 3/2014 |
| KR | 20040035952 | | 4/2004 |
| KR | 1020040035952 | | 4/2004 |
| KR | 101535411 | | 7/2015 |
| WO | 0210040 | | 2/2002 |
| WO | 02100040 | | 12/2002 |
| WO | 02100040 | A | 12/2002 |
| WO | 2006136662 | | 12/2006 |
| WO | 2006136662 | A | 12/2006 |
| WO | 2010144490 | | 12/2010 |
| WO | 2010144490 | A | 12/2010 |
| WO | 2012151290 | | 11/2012 |
| WO | 2012151290 | A | 11/2012 |
| WO | 2014151249 | | 9/2014 |

OTHER PUBLICATIONS

"Assa Abloy trials remote hotel check-ins", © 2012 AOL Inc., [online). Retrieved from the Internet: <URL: http://www.engadget.com/2010/11 /02/assa-abloy-trials-remote-hotel-checkins-unlockinq-your-room-wi/>, (Accessed Apr. 23, 2012), 2 pgs.

"Cell phone controlled door lock", Copyright © 2012, Hack a Day, [online]. Retrieved from the Internet: <URL: http://hackaday.com/2007/07/17/cell-phone-controlled-door-lock/>, (Accessed Apr. 23, 2012), 11 pgs.

"ECKey—Turn your phone into a Key!", [online}. Retrieved from the Internet: <URL: http://www.eckev.com/>, (Accessed Apr. 23, 2012), 2 pgs.

"iDoor—iPhone Controlled Hydraulic Door", Chris Varenhorst chris@localhost, [online]. Retrieved from the Internet: <URL: http://varenhor.st/2009/07/idoor-iphone-controlledhydraulic-door/>, (Accessed Apr. 23, 2012), 12 pgs.

"Keyless entry via SMS", Copyright © 2012, Hack a Day, [on line]. Retrieved from the Internet: <URL: http://hackaday.com/2011 /01 /24/keyless-entry-via-sms/, (Accessed Apr. 23, 2012), 9 pgs.

"Knock detecting lock", Copyright © 2012, Hack a Day, [online]. Retrieved from the Internet: <URL: http://hackaday.com/2009/11 /04/knock-detecting-lock/>, (Accessed Apr. 23, 2012), 10 pgs.

"Knock response automatic door opener", Copyright © 2012, Hack a Day, [on line]. Retrieved from the Internet: <URL: http://hackaday.com/2007/06/11/knock-responseautomatic-door-opener/>, (Accessed Apr. 23, 2012), 9 pgs.

"More cellphone controlled door locks", Copyright © 2012, Hack a Day, [online]. Retrieved from the Internet: <URL: http://hackaday.com/2010/02/23/more-cellphone-controlled-doorlocks/>, (Accessed Apr. 23, 2012), 10 pgs.

"Nexia Home Intelligence", Nexia™, [online]. Retrieved from the Internet: <URL: http://www. nexiahome .com/Products/ProductCatalog .aspx?catsel=5>, (Accessed Apr. 23, 2012), 2 pgs.

"Oliver Nash's Blog", [online]. Retrieved from the Internet: <URL: http ://ocfnash. wordpress .com/2009/10/31 /locked-out-at-2am/>, (Accessed Apr. 23, 2012), 18 pgs.

"Open Ways", OpenWays copyright 2011 , [online]. Retrieved from the Internet: <URL: http://www.openways.com/>, (Accessed Apr. 20, 2012), 1 pg.

"Opening a door via text message", [online]. Retrieved from the Internet: <URL: http:/ /anerroroccurredwhileprocessingthisdirective .com/2011 /01/01 /opening-a-door-via-textmessage/>, (Accessed Apr. 23, 2012), 8 pgs.

"Phantom Keyless Home Entry", Copyright © 2012 Phantom Smart Home, LLC, [online]. Retrieved from the Internet: <URL: http://phantomsmarthome.com/, (Accessed Apr. 23, 2012), 1 pg.

"Remote entry via Android and Launchpad", Copyright © 2012, Hack a Day, [online]. Retrieved from the Internet: <URL: http://hackaday.com/2012/01/24/remote-entry-viaandroid-and-launchpad/>, (Accessed Apr. 23, 2012), 9 pgs.

"SimpliciKey Electronic Door Look Solutions", Copyright © 2011 SimpliciKey TM, [online ]. Retrieved from the Internet: <URL: http://simplicikey.com/>, (Accessed Apr. 23, 2012), 1 pg.

"Unlock you door with Siri, SMS, or a secret knock", © 201 O laan labs, [online]. Retrieved from the Internet: <URL: http://labs.laan.com/wp/2011/10/unlock-your-door-with-siri-sms-ora-secret-knock/>, (Accessed Apr. 23, 2012), 11 pgs.

"USB Auth—Makers Local 256", Wiki pages, (online]. Retrieved from the Internet: <URL: https://256.makerslocal.orq/wiki/index.php/USB Auth>, (Accessed Apr. 23, 2012), 9 pgs.

"Viper SmartStart", © Copyright 2012 Directed., [online]. Retrieved from the Internet: <URL: http://www.vioer.com/smartstartl>, (Accessed Apr. 23, 2012), 2 pgs.

"Yale demos NFC-enabled residential locks, germaphobes rejoice", © 2012 AOL Inc, onlinel. Retrieved from the Internet: <URL:, (Accessed Apr. 23, 2012), 4 pgs.

"Zwave Products", Copyrights © 2012—Zwave Products Inc, [online]. Retrieved from the Internet: <URL: http://www.zwaveoroducts.com/KWIKSET.html>, (Accessed Apr. 23, 2012), 3 pgs.

Computer rendering of deadbolt lock publicly available before Aug. 1, 2017, 1 page.

English Abstract of KR 210040035952.

Phantom Smart Snart Home; Hands-Free Keyless Home Entry, https://web.archive.org/web/20110222072442/http:/www.phantomsmarthome.com/; 3 pages, copyright 2011.

RGJ.com website, https://www.rgj.com/story/life/food/2017/09/05/only-rgj-com-uber-eats-debuts-wednesday-reno/632015001/, dated Sep. 5, 2017, 4 pages.

Sorex_wirelessKey_2_0-Sorex Wayback site of Sep. 6, 2011, 2 pages.

SOREX_wirelessKey_Folder_2009, 2 pages.

The Verge website, https://www.theverge.com/2017/10/25/16538834/amazon-key-in-home-delivery-unlock-door-prime-cloud-cam-smart-lock, dated Oct. 25, 2017, 5 pages.

Two-Factor Authentication with Proximity Uses iBeacon Bluetooth Low Neergy (BLE) to Authenticate Users Instantly, https://saaspass.com/technologies/proximity-instant-login-two-factor-authentication-beacon.html, 5 pages, Known as early as Nov. 6, 2017.

Two-Factor Authentication with Proximity Uses iBeacon Low Energy (BLE) to Authenticate Users Instantly, https//saaspass.com/technologies/proximity-instant-login-two-factor-authentication-beacon.html, 5 pages, KNown as early as Nov. 6, 2017.

Wayback Machine capture of https://about.ubereats.com, capture dated Jun. 3, 2017, 7 pages.

Wayback Machine capture of https://en.wikipedia.org/wiki/Sally_port, capture dated Nov. 11, 2016, 3 pages.

WirelessKey Hardware Deutsch 1.1 Dec. 6, 2011 Wayback Machine.

YouTube Video entitled Bluetooth Sorex Wirelss Key, dated Mar. 5, 2009.

YouTube Video entitled Bluetooth SorexLoXX Entrance System, dated Mar. 5, 2009.

YouTube Video entitled Bluetooth-Sorex LoXX dated Feb. 5, 2009.

(56) References Cited

OTHER PUBLICATIONS

Hot Stuff: [Morning Edition]; by Andre Mouchard: The Orange County Register; Publication Jul. 20, 1998; 3 pages, https://dialog.proquest.com/professional/printviewfile?accountid=. . . .
Inventors Devise New Mailboxes for Bulky E-Commerce Packages; The Wall Street Journal; by Robert Johnson—Staff Reporter of the Wall Street Journal; 4 pages, Updated Aug. 17, 1999.
U.S. Appl. No. 16/383,093, filed Apr. 12, 2019; 64 pages.
Todd Bishop; Creeped out by Amazon Key? How the In-Home Delivery Service Will Work; https://www.geekwire.com/author/todd/) on Oct. 26, 2017.
Amazon Help; How In-Home Delivery Works; https://www.amazon.com/gp/help/customer/display.html?nodeId=202104360; 2 pages; publicly available as early as Oct. 2017.
"iDoor—iPhone Controlled Hydraulic Door", http://varenhor.st/2009 /07 /idoor-i phone-contro lied-hydraulic-door/, retrieved Apr. 23, 2012, 12 pages.
PCT Patent Application No. PCT/US2019/027632; International Search Report and Written Opinion dated Aug. 4, 2019, 10 pages.

* cited by examiner

SYSTEM FOR FACILITATING ACCESS TO A SECURED AREA

CROSS-REFERENCE TO RELATED APPLICATIONS

This application claims the benefit of U.S. Provisional Patent App. No. 62/659,535, filed Apr. 18, 2018 and U.S. Provisional Patent App. No. 62/540,047, filed Aug. 1, 2017, which are both hereby incorporated by reference herein in their entiretites.

FIELD

This disclosure relates to barrier operators and, more specifically, to a system and method for facilitating a grant of conditional, temporary authorization to operate a movable barrier operator associated with a secured area.

BACKGROUND

Moveable barrier operators, such as garage door openers, secure areas and move barriers in response to received signals from transmitters. Different kinds of transmitters, such as portable transmitters or stationary transmitters, may be used to operate moveable barrier operators. One type of a stationary transmitter is a keypad mounted near the movable barrier.

In one prior system, a user orders a product online and a delivery service is able to open a user's garage door to complete an unattended delivery of the ordered product because a computer of the delivery service can communicate with a home automation system associated with the garage door opener. Temporary or one-time access can be granted to the delivery person or associate by establishing and providing a temporary or one-time use entry code. The delivery person enters the one-time use entry code into an outdoor, stationary keypad near the garage door, and the code is communicated to the garage door opener such that the garage door opener opens the garage door. The one-time use entry code differs from the code used by the residents to operate the moveable barrier operator. Temporary or one-time access may be given to other types of guests besides delivery associates, such as contractors or visitors.

While temporary or one-time use codes limit the number of times and/or amount of time a guest can open the barrier, they do not limit access to the secured area once beyond the moveable barrier. For example, access to an attached garage provides access to a passageway door of the garage which leads to an interior of the associated house or multi-tenant building. In some instances a resident or a home owner may wish to give a guest access to the garage without permitting the guest to open the passageway door. Accordingly, the passageway door should be kept locked, necessitating the resident to carry a key, fob, keycard, or the like. Additionally, if multiple guests are granted temporary or one-time entry codes, some may have to be given keys to the passageway door if access to the house is necessary.

DETAILED DESCRIPTION

Figure 1:
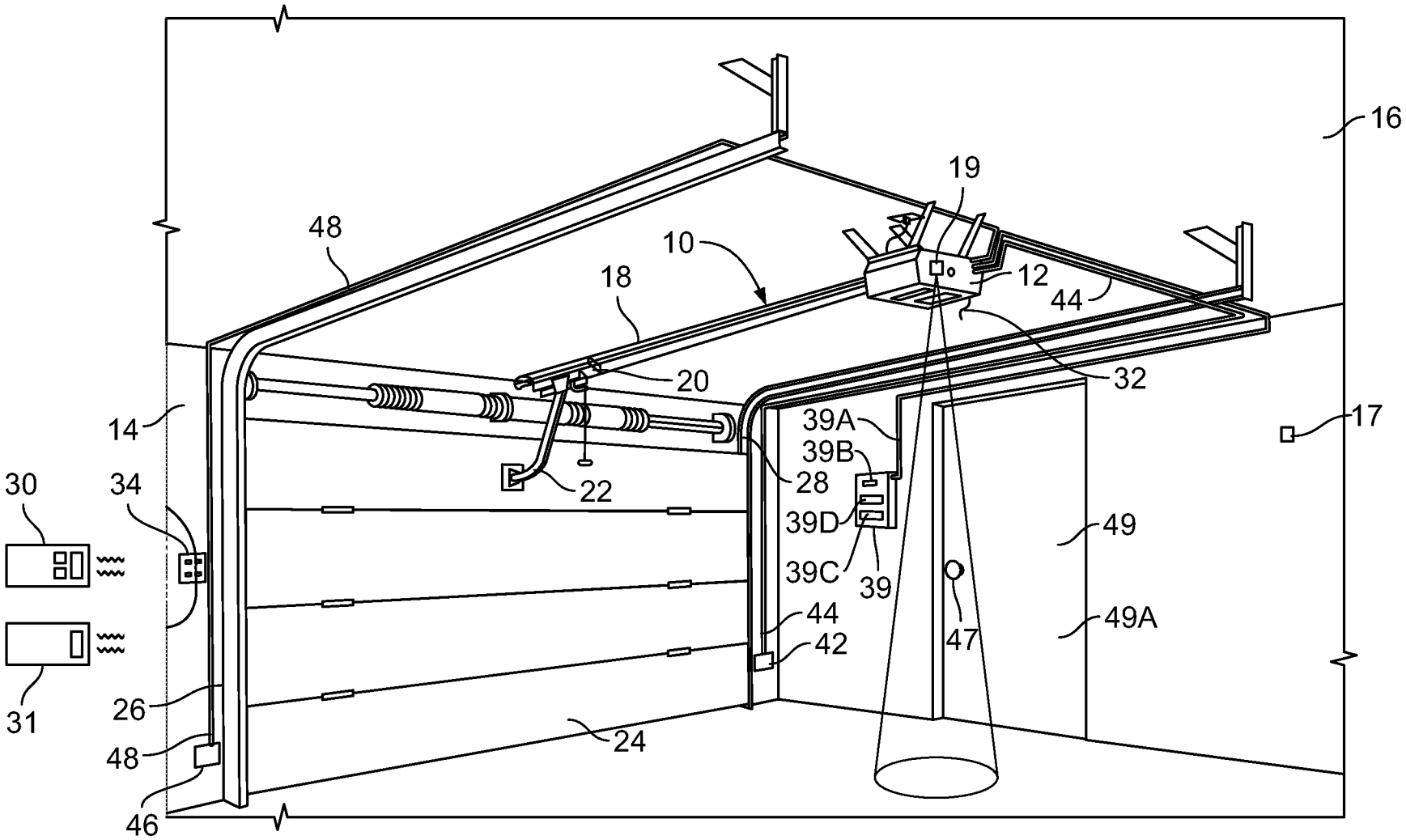
FIG. 1 is a perspective view of a garage having a movable barrier operator and a passageway door.

In accordance with one aspect of the present disclosure, a system is provided for controlling access to a secured area having a first barrier and a second barrier. The system includes a moveable barrier operator configured to control movement of the first barrier, such as a movable barrier, and a lock configured to secure the second barrier, such as a passageway door. In one form, the moveable barrier operator is a garage operator (also known as a garage door opener, garage door operator, or GDO) and the passageway door is a door leading from the garage to an adjacent area or attached structure, such as a house. The system receives a control signal including a code from a remote control. The remote control may be a wireless transmitter such as a visor-mounted transmitter, a fixed transmitter, such as a keypad, or a portable electronic device, such as a smartphone. The system authenticates the signal to determine whether the received signal is a primary signal (associated with a resident) or a secondary signal (associated with a guest) based at least in part on a code (e.g., a fixed identification (ID) code that uniquely identifies the remote control or transmitter) of the signal. The primary signal is associated with a first level of access that permits a user to pass through both the garage door and the passageway door. The secondary signal is associated with a second level of access that permits a user to pass through the garage door but not the passageway door. As such, the system opens the garage door and unlocks the passageway door in response to a primary signal and opens the garage door and locks the passageway door in response to a secondary signal. In some forms, the movable barrier operator moves the garage door a first distance (e.g., fully opens the garage door) in response to a primary signal and opens the garage door a shorter distance (e.g., just far enough to slide in a package for delivery) in response to a secondary signal. The secondary signal may include information regarding how far the movable barrier operator should open the garage door.

In some forms, the type of signal is determined by the movable barrier operator. The signal may be sent to the movable barrier operator directly from the remote control, such as if the remote control is a visor-mounted transmitter. Alternatively, the signal may be sent to the garage door indirectly such as if the remote control is a smartphone. For example, a user may use an application running on her smartphone to send a signal to cause the movable barrier operator open or close the garage door. The smartphone sends the signal to a cloud-based computing device such as a server computer. The server computer determines whether the smartphone is associated with a resident or a guest, and sends either a primary signal or the secondary signal to the movable barrier operator.

If the movable barrier operator receives a primary signal, the movable barrier operator transmits a signal that causes a lock of the passageway door to unlock. In some forms, the movable barrier operator transmits a signal directly to the passageway door lock. Alternatively, the movable barrier operator and passageway door lock are both communicatively coupled to a common local communication hub. The operator transmits a signal to a server computer via the local communication hub and the server computer sends another signal through the local communication hub to the passageway door lock to control the passageway door lock.

If the movable barrier operator receives a secondary signal, the movable barrier operator transmits a signal that causes the passageway door lock to become locked. In one form, the passageway lock includes a sensor configured to determine if the lock is in a locked state or unlocked state. The state of the passageway lock may be transmitted directly or indirectly from the passageway lock to the movable barrier operator. The movable barrier operator analyzes the transmitted signal to check the state of the passageway lock and determine if the state of the passageway lock needs to be changed. The analysis of the transmitted signal may include decrypting the transmitted signal. The moveable barrier operator or the server computer transmits a lock or unlock command to the lock directly or indirectly if the lock is not in the desired state. Further, the state of the lock may be stored locally such as in a memory of the lock, the operator, or a local hub. In another embodiment, the state of the lock is stored on a remote server computer.

In alternative forms, the determination of whether a control signal is a primary signal or a secondary signal is made by a device other than the movable barrier operator, such as a remote server computer. For example, a smartphone transmits a control signal to the server computer. The server computer determines whether the signal is a primary signal or a secondary signal and sends actuation signals to the moveable barrier operator and passageway door lock as needed to effectuate the level of access associated with he control signal.

Referring now to FIG. 1, a garage 14 having a movable barrier operator system 10 is provided. The movable barrier operator system 10 includes a movable barrier operator 12, such as a garage door opener, mounted within a secured area, such as a garage 14. More specifically, the movable barrier operator 12 is mounted to a ceiling 16 of the garage 14 and includes a rail 18 extending therefrom with a releasable trolley 20 attached having an arm 22 extending to a multiple paneled garage door 24 positioned for movement along a pair of door rails 26 and 28. The movable barrier operator 12 has a motor coupled to the door 24 by the trolley 20 and arm 22, by which the motor moves the door 24. The system 10 includes remote controls such as hand-held transmitter units 30, 31 configured to send signals for reception by communication circuitry through an antenna 32 of the movable barrier operator 12. The remote controls may also include an external control pad 34, with a button or buttons thereon, that is positioned on the outside of the garage 14. The external control pad 34 communicates signals via radio frequency transmission for reception by the antenna 32 of the movable barrier operator 12. A switch module 39 is mounted on a wall of the garage 14. The switch module 39 is connected to the movable barrier operator 12 by one or more wires 39A although the switch module 39 may alternatively communicate with the movable barrier operator 12 wirelessly or via a combination of wired and wireless signals. The switch module 39 includes a light switch 39B, a lock switch 39C, and a command switch 39D. An optical emitter 42 is connected via a power and signal line 44 to the movable barrier operator 12. An optical detector 46 is connected via a wire 48 to the movable barrier operator 12. Alternatively, at least one of the optical emitter 42 and the optical detector 46 may communicate wirelessly with the movable barrier operator 12. Furthermore, the optical emitter 42 and the optical detector 46 may be combined as a single unit known in the art as a retroreflector.

The movable barrier operator system 10 includes a wired or wireless camera 17 situated to capture security data such as pictures, video, and/or audio within the garage 14. The camera 17 may be configured to continuously capture security data. Alternatively, the camera 17 captures security data at certain times. For example, the camera 17 may be configured to start capturing security data when the movable barrier operator system 10 opens or begins to open the garage door 24. The camera 17 continues capturing security data until the garage door 24 is closed or a predetermined amount of time after the garage door 24 is closed. In further examples, the camera 17 is configured to start capturing security data in response to the system 10 determining that a received control signal is a secondary signal but not in response to a determination that a received control signal is a primary signal.

In some forms, the camera 17 is remotely movable such that a user viewing a video stream from the camera 17 via a wireless device, such as a smartphone, can adjust the camera 17 to change the field of view. The moveable barrier operator system 10 includes an adjustable indicator 19 for indicating a position within the garage 14. The indicator 19 may be integral with or independent from the moveable barrier operator 12. The indicator 19 projects light, such as a cone of light, to illuminate an area. For example, the indicator 19 may include one or more lightbulbs or LEDs directed to form a shape such as a cone, a pyramid, a circle, or a rectangle on a surface such as the floor of the garage 14. Alternatively or additionally, the indicator 19 includes a laser to form one or more shapes on a surface such as a small circle, a rectangle, and/or an arrow on the floor of the garage 14. The indicator 19 may alternatively or additionally include a speaker and/or a display screen to indicate the desired dropoff location.

The indicator 19 may be used to assist in parking a vehicle within the garage 14. Further, the indicator 19 may be used to indicate a point or illuminated area in the garage 14 for delivery associates to drop or otherwise deposit or place packages or parcels. In some forms, the indicator 19 includes one or more servo motors and is remotely controllable such that the user can use, for example, an application running on the user's smartphone to adjust the indicator 19 in real-time to indicate a desired location for a package within the garage 14 to a delivery associate. The moveable barrier operator 12 may store programmed orientations for the indicator 19 and may adjust the orientation of the indicator 19 based on the operation of the movable barrier operator system 10. For example, the movable barrier operator 12 uses a first stored orientation of the indicator 19 when the user enters the garage 14 to aid in parking. The movable barrier operator 12 uses a second stored orientation of the indicator 19 when a delivery associate enters the garage 14 to indicate a delivery location. Once the delivery associate has delivered the package in the garage 14, the indicator 19 reverts back to the first orientation to assist in parking within the garage 14.

In operation, the indicator 19 is operated to indicate the stored desired location in response to a control signal being authenticated as a secondary signal, but not in response to a control signal being authenticated as a primary signal.

In another embodiment, the user may specify package delivery location by having the movable barrier operator 12 detect a specific action performed by the user. For example, the movable barrier operator 12 may include one or more microphones and the movable barrier operator 12 is configured to use the microphones for voice recognition and/or sound localization. As an example, the movable barrier operator 12 may be configured to detect the user speaking a trigger word or phrase when the user is within the garage 14 such as "deliver here!" followed by stomping her foot twice at a spot on a floor of the garage 14. The movable barrier operator 12 may detect the desired location using audio sensors (e.g., triangulating position using microphones) and/or using optical position sensors. The movable barrier operator 12 may then operate the indicator 19 to indicate the desired location when the delivery associate enters the garage 14.

In some forms, the moveable barrier operator 12 further includes a speaker and/or a microphone such that verbal communications can be exchanged between a delivery associate within the garage 14 and a remote user.

Figure 2:
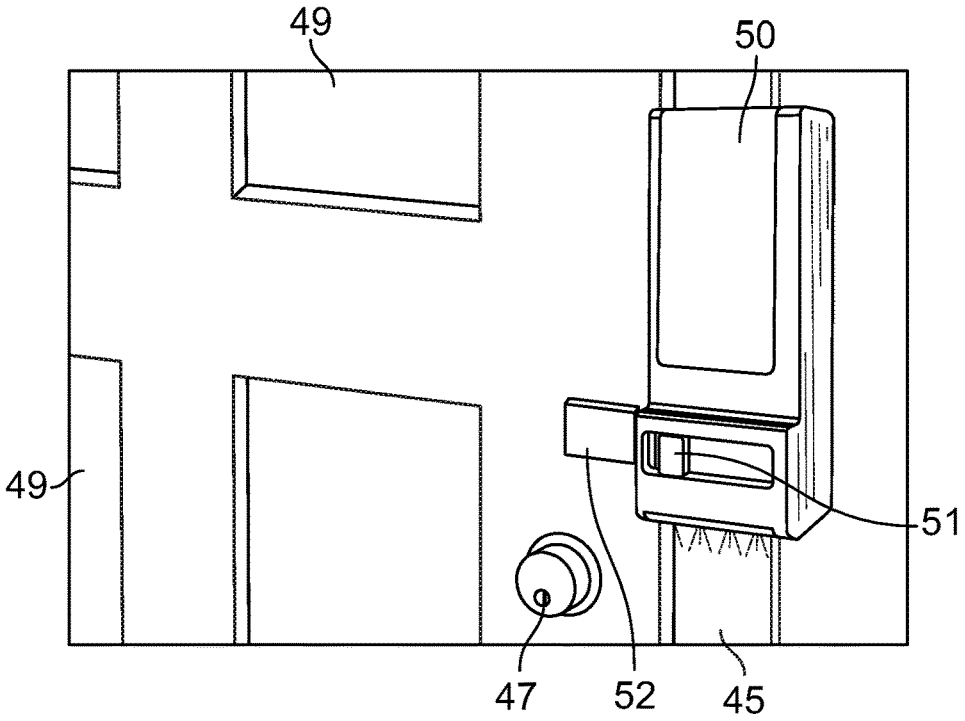
FIG. 2 is a perspective view of the passageway door of FIG. 1 having a passageway door lock on an interior side of the door.

The garage 14 includes a passageway door 49 having hardware 47, such as a doorknob and/or deadbolt. The door 49 separates the garage 14 from an adjacent area or attached structure, such as a house, that is desired to be secured in certain instances. The door 49 has an exterior surface 49A facing the garage 14 and an interior surface 49B facing the house. FIG. 2 is a perspective view of the interior side 49B of the door 49. A passageway door lock 50 is mounted adjacent the door 49 such that a bolt 52 of the lock 50 may obstruct the door 49 by inhibiting an inward swing of the door 49, thereby preventing the door 49 from being opened. The movable barrier operator 12 is in communication with the lock 50 and may cause automatic locking of the lock 50 in response to a guest such as a delivery associate opening the garage door 24. In one form, the lock 50 includes a manual actuator 51 enabling a user to manually shift the bolt 52 between unlocked and locked positions and open the door 49. The lock 50 is mounted to a door jamb 45 associated with the door 49 such that the bolt 52 extends along a portion of the door's interior surface 49B. In one form, neither the door 49 nor the jamb 45 need to be modified, such as by cutting mortises or cavities, to receive the bolt 52 or the lock 50.

Figure 3:
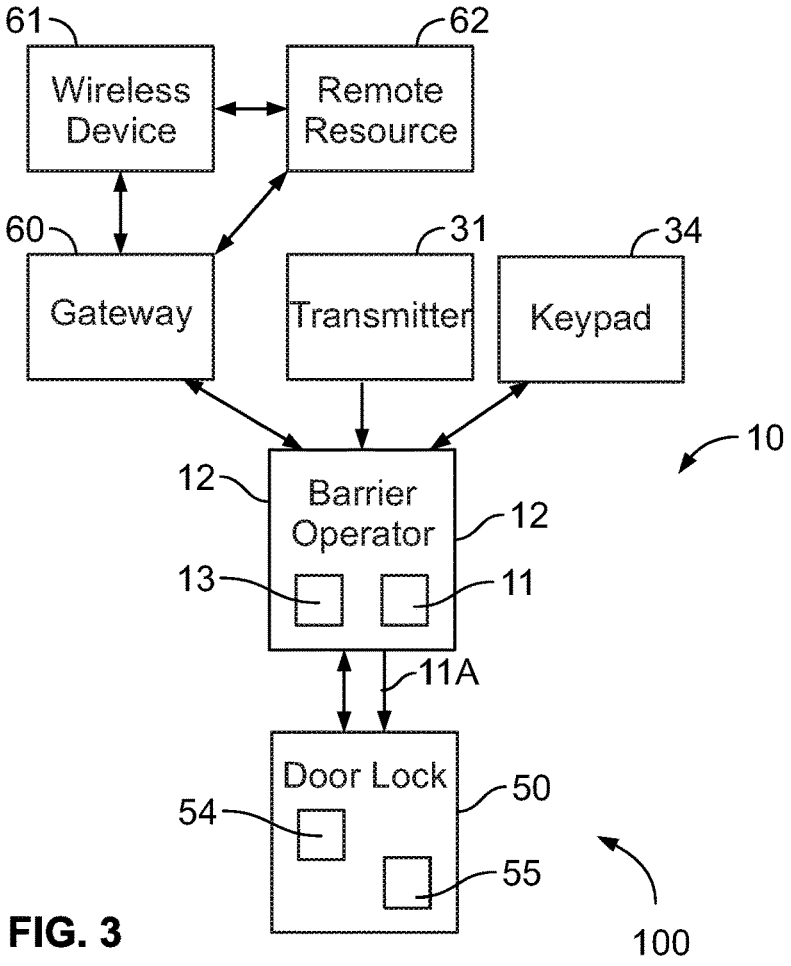
FIG. 3 is a block diagram of a system including the movable barrier operator and the passageway door lock of FIGS. 1 and 2.

A passageway lock system 100 is provided as a block diagram in FIG. 3 and includes the moveable barrier operator 12 and the lock 50. The moveable barrier operator 12 includes wireless communication circuitry 11, such as a receiver and transmitter or a transceiver. The movable barrier operator 12 also includes a controller 13 that includes a processor and a non-transitory computer readable memory.

The wireless communication circuitry 11 may be configured to communicate over one or more frequencies, such as standard 300 MHz-400 MHz frequencies, and one or more protocols, such as Bluetooth®, Wi-Fi, ZigBee, or infrared (IR). In one form, the wireless communication circuitry 11 includes a transceiver (or a separate receiver and transceiver) for communicating via 300 MHz-400 MHz signals with a garage door opener transmitter, as well as a Bluetooth® and/or Wi-Fi transceiver (or a separate transmitter and receiver) for communicating with the lock 50 and/or a gateway 60. The gateway 60 may provide wireless access to an external network, such as the internet. The gateway 60 may be a router, access point or a "smart" house hub. Although the lock 50 is shown as communicating with the moveable barrier operator 12, the lock 50 may additionally or alternatively communicate with gateway 60. In an example the lock 50 and the moveable barrier operator 12 communicate indirectly with each other via gateway 60 and/or a cloud (e.g., network-based service) that is instantiated or otherwise executed by a remote entity such as a network device or server computer.

In operation, the movable barrier operator 12 receives a signal. The signal can be transmitted from one of multiple remote controls, including the keypad 34, the portable transmitters 30, 31, or another remote control such as a wireless device 61. The wireless device 61 may be a smartphone or tablet communicatively coupled to the movable barrier operator 12 by the gateway 60. For example, a user may send open or close commands to the movable barrier operator 12 using an application running on the user's smartphone. The user's smartphone communicates with a remote resource 62, such as a server, via a cellular telephone system and the internet. In response to receiving the communication from the user's smartphone, the remote resource 62 sends a signal to the movable barrier operator 12 via the internet. The signal may include data representing the identity of the smartphone and/or user and a code associated with the moveable barrier operator 12. If the signal is sent using the keypad 34, the keypad 34 sends a code entered by a user to the moveable barrier operator 12. A controller 13 of the moveable barrier operator 12 parses and decrypts the signal to determine if the code(s) are valid, and determines the permissions associated with the identified remote control and/or user. Among the permissions determined by the moveable barrier operator 12 is whether to unlock the lock 50 to give access to the house.

If an identified user/remote control is permitted access to the garage 14 and the house, the moveable barrier operator 12 transmits a signal 11A to the door lock 50 containing a command to unlock the passageway door 49. The door lock 50 receives the command at communication circuitry 54, which may include a receiver and a transmitter, and actuates the bolt 52 (FIG. 2) into an unlocked or retracted position. In some forms, the signal 11A transmitted to the door lock 50 is encrypted, and the door lock 50 includes a controller 55 configured to decrypt the signal. The signal 11A may be sent via wired or wireless approaches.

If the identified user/remote control is permitted access to the garage 14 but is not permitted access to the house, the moveable barrier operator 12 transmits the signal 11A containing a lock command to the door lock 50. The door lock 50 receives the signal 11A at the communication circuitry 54 and in response, actuates the bolt 52 into a locked or extended position. The movable barrier operator 12 thereby causes the door lock 50 to secure the door 49 (FIGS. 1 and 2) before or concurrent with the movable barrier operator 12 starting to open the garage door 24. If the movable barrier operator 12 receives the signal 11A from a remote control that is unauthorized, the movable barrier operator 12 does not open the garage door 24.

Figure 4A:
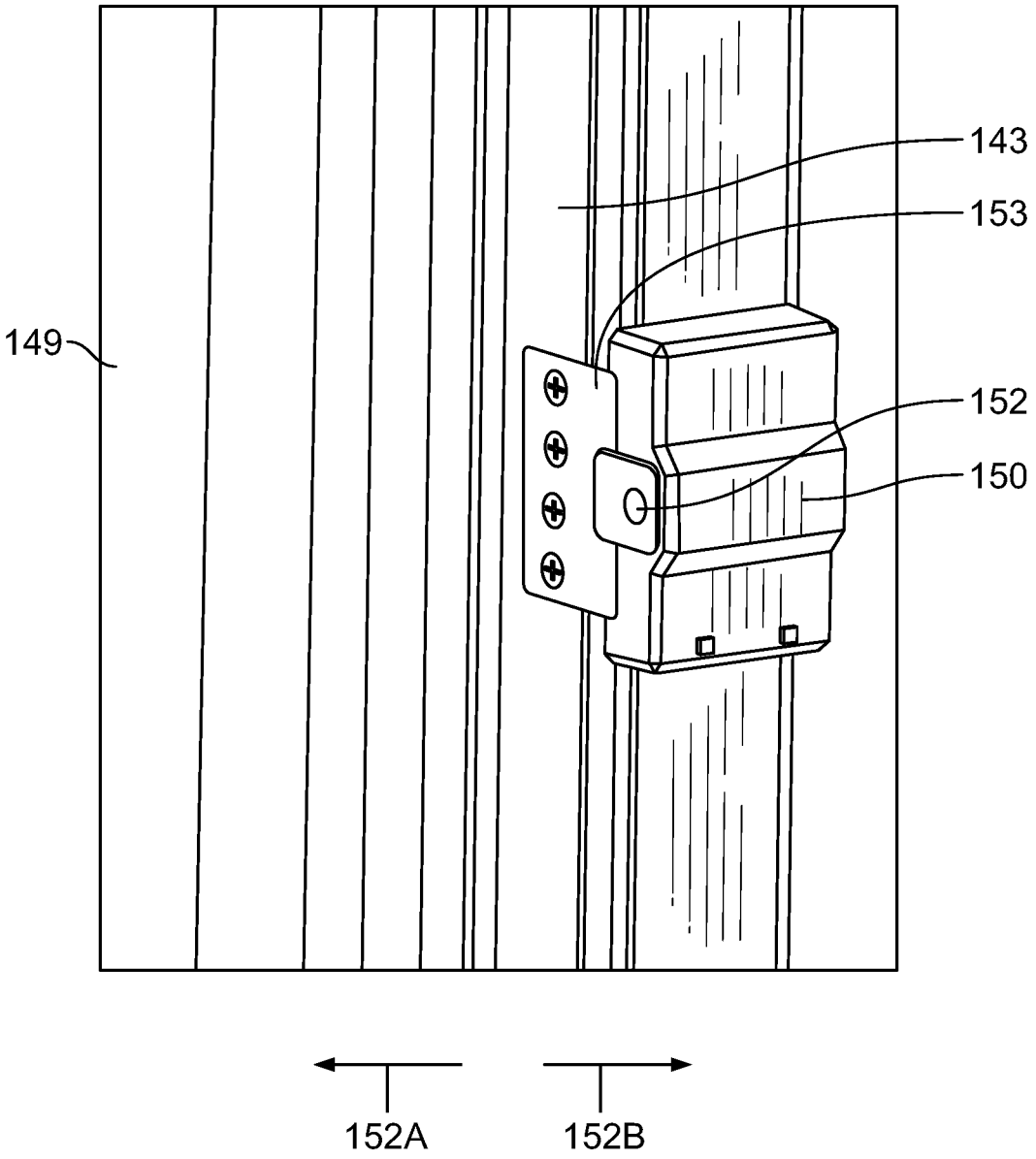
FIG. 4A is a perspective view of a passageway door lock.
Figure 4B:
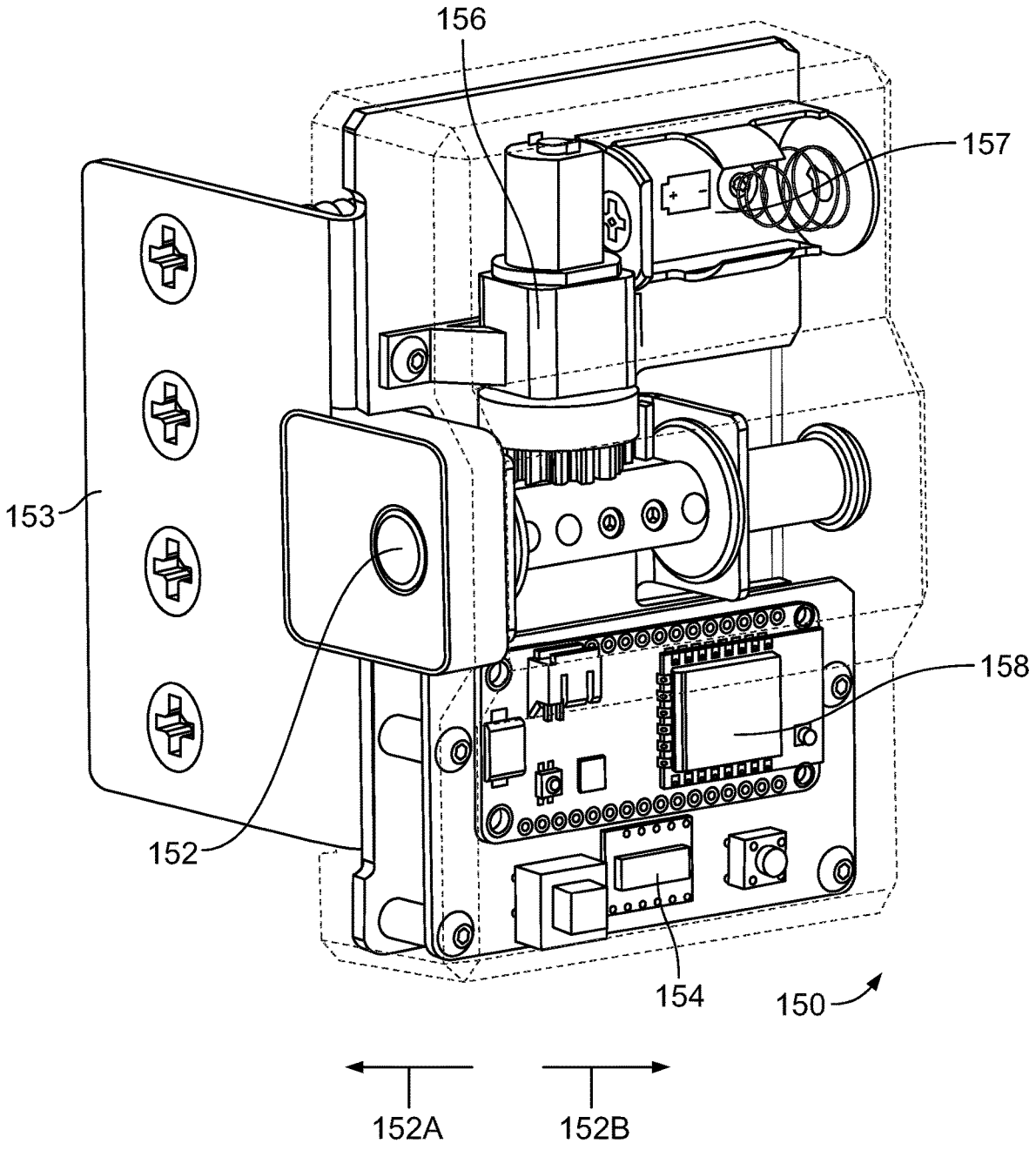
FIG. 4B is a perspective view of the lock of FIG. 4A with a housing of the lock transparent to show internal components of the lock.
Figure 4C:
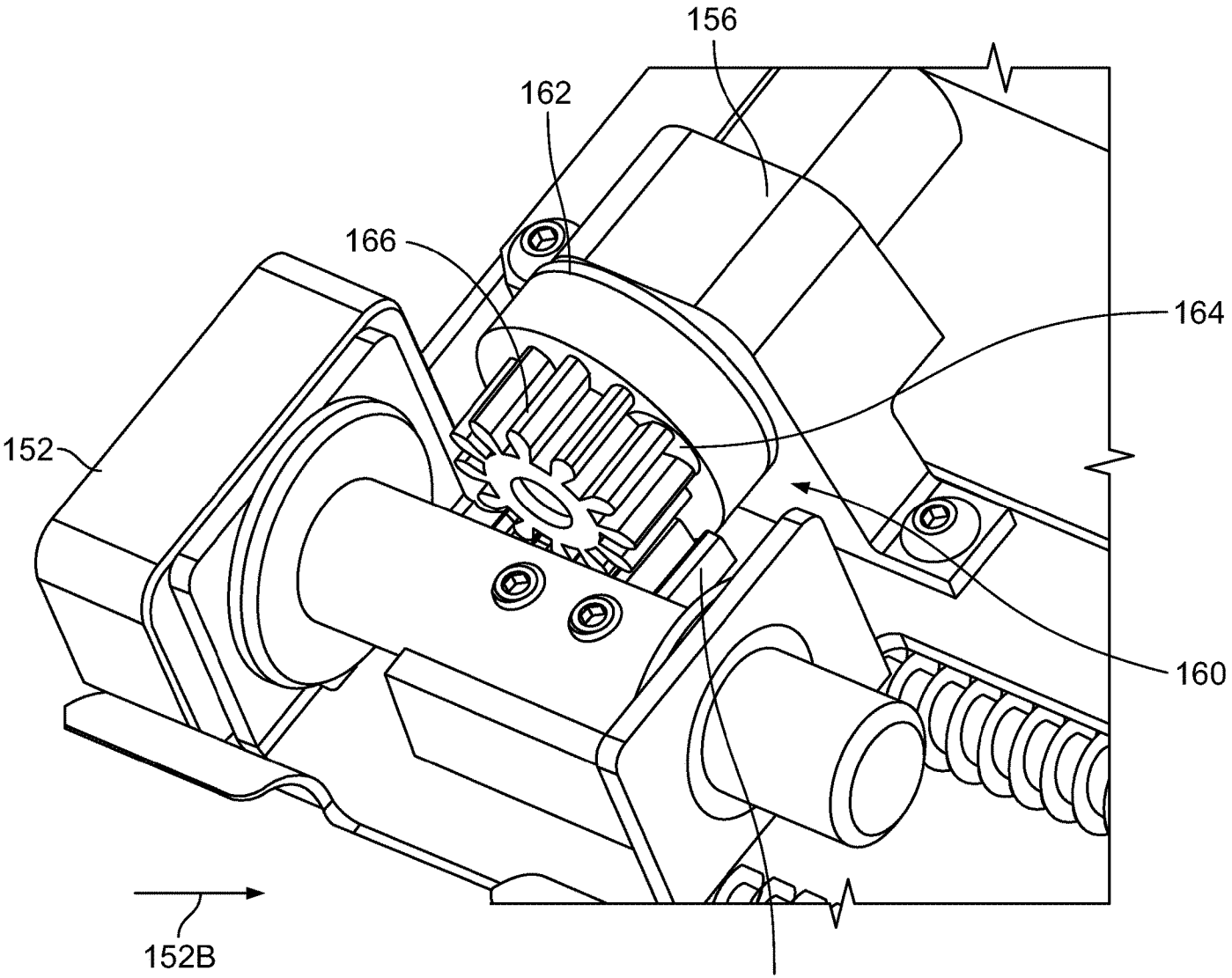
FIG. 4C is a perspective view of drive elements of the lock of FIGS. 4A and 4B.

FIGS. 4A-4C illustrate a passageway door lock 150 configured to secure a passageway door 149. The lock 150 includes a bolt 152 shiftable in direction 152A to an extended position to obstruct opening of the door 149 when the door 140 is closed. The lock 150 is mounted adjacent the door 149 by a mounting plate 153 secured to a door jamb 143. In one form, the mounting plate 153 is secured to the jamb 143 by a plurality of fasteners such as screws or nails long enough to extend into a structural or supporting member (e.g., a metal or wood stud) adjacent to the door 149. The bolt 152, mounting plate 153, and other components of the lock 150 may be made of steel, alloy or other material having high strength.

With reference to FIG. 4B, the lock 150 includes a rotary or linear actuator such as an electric motor 156 configured to drive or actuate the bolt 152. The electric motor 156 is operable to drive the bolt 152 in direction 152A to extended, locked position or in direction 152B to a retracted, unlocked position. The electric motor 156 is powered by a power source 157, such as a battery. In some forms, the lock 150 is additionally or alternatively wired to the electrical system of the house or associated structure. The motor 156 is controlled by a controller 158 and/or associated circuitry. A receiver 154 is communicatively coupled to the controller 158. In operation, the receiver 154 receives a signal from the moveable barrier operator 12 and/or the gateway 60 and transmits the received signal to the controller 158. The controller 158 analyzes the signal to determine whether to operate the motor 156. The controller 158 then connects the motor 156 to the power source 157 such that the electric motor 156 drives the bolt 152 to the locked or unlocked position.

In one form, the lock 150 includes a slip clutch 160 as shown in FIG. 4C. The slip clutch 160 includes a metal plate 162 coupled to a drive shaft of the motor 156. When the motor 156 is powered, the motor 156 rotates the plate 162. A magnet 164 is mounted to the plate 162. The magnet 164 is coupled magnetically to a pinion gear or sprocket 166 that engages a toothed rack 166A fixed to the bolt 152. In standard operation, rotating the plate 162 causes the magnet 164 and, in turn, the sprocket 166 to rotate. Teeth of the rotating sprocket 166 mesh with complementary teeth of the rack 152A and cause the bolt 152 to be driven inwardly in direction 152B or outwardly in direction 152A. However, if force is applied to the bolt 152 in direction 152B, such as by a manual actuator (e.g., actuator 51 of FIG. 2), the bolt 152 imparts torque on the sprocket 166 causing the magnet 164 to rotate or slip relative to the plate 162. The slipping allows the bolt 152 to be moved without turning the driveshaft of the motor 156 and possibly damaging the motor 156. The slipping permits a person inside of the house to manually shift the bolt 152 to an unlocked position to open the door 149.

Figure 5A:
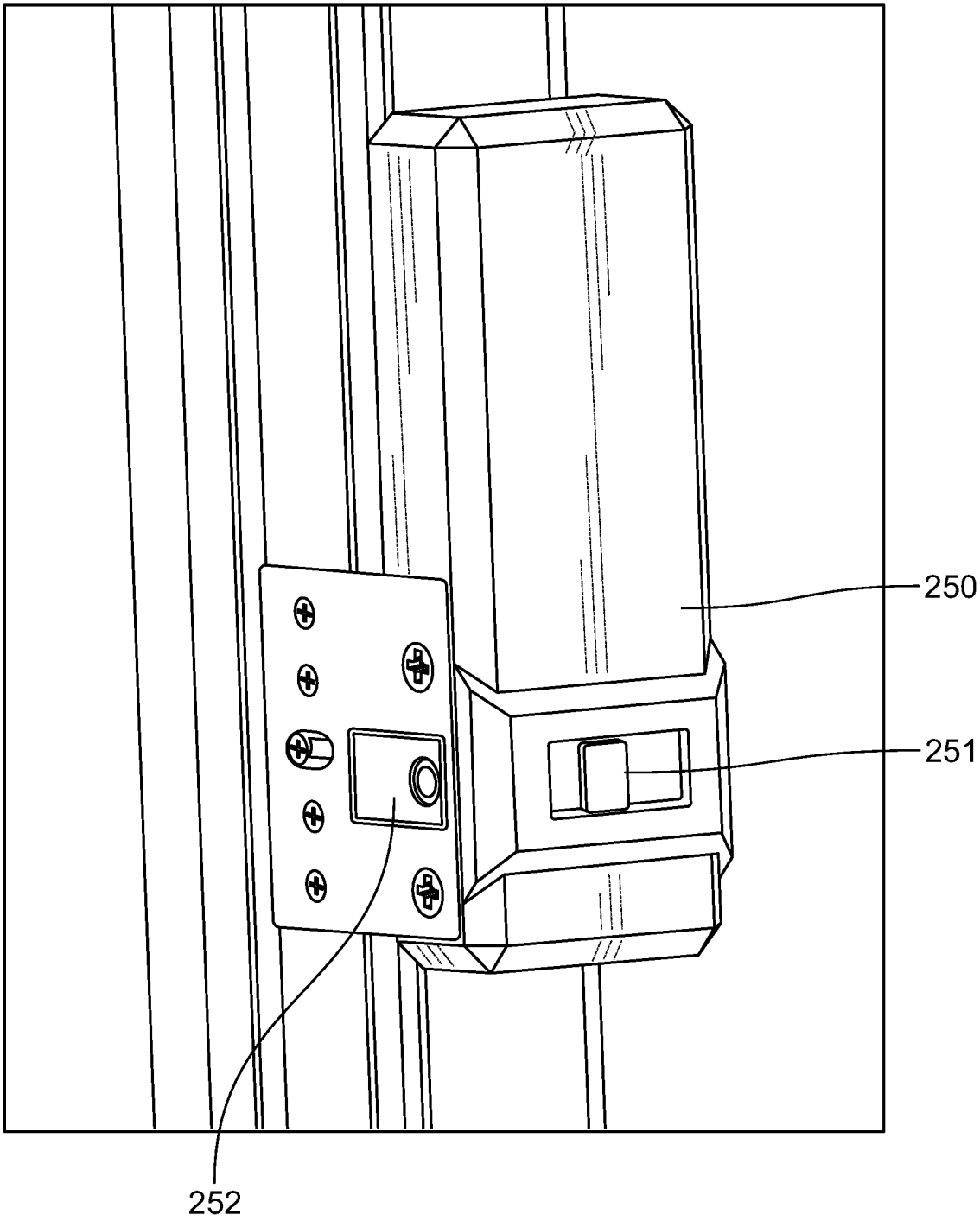
FIG. 5A is a perspective view of a passageway door lock.
Figure 5B:
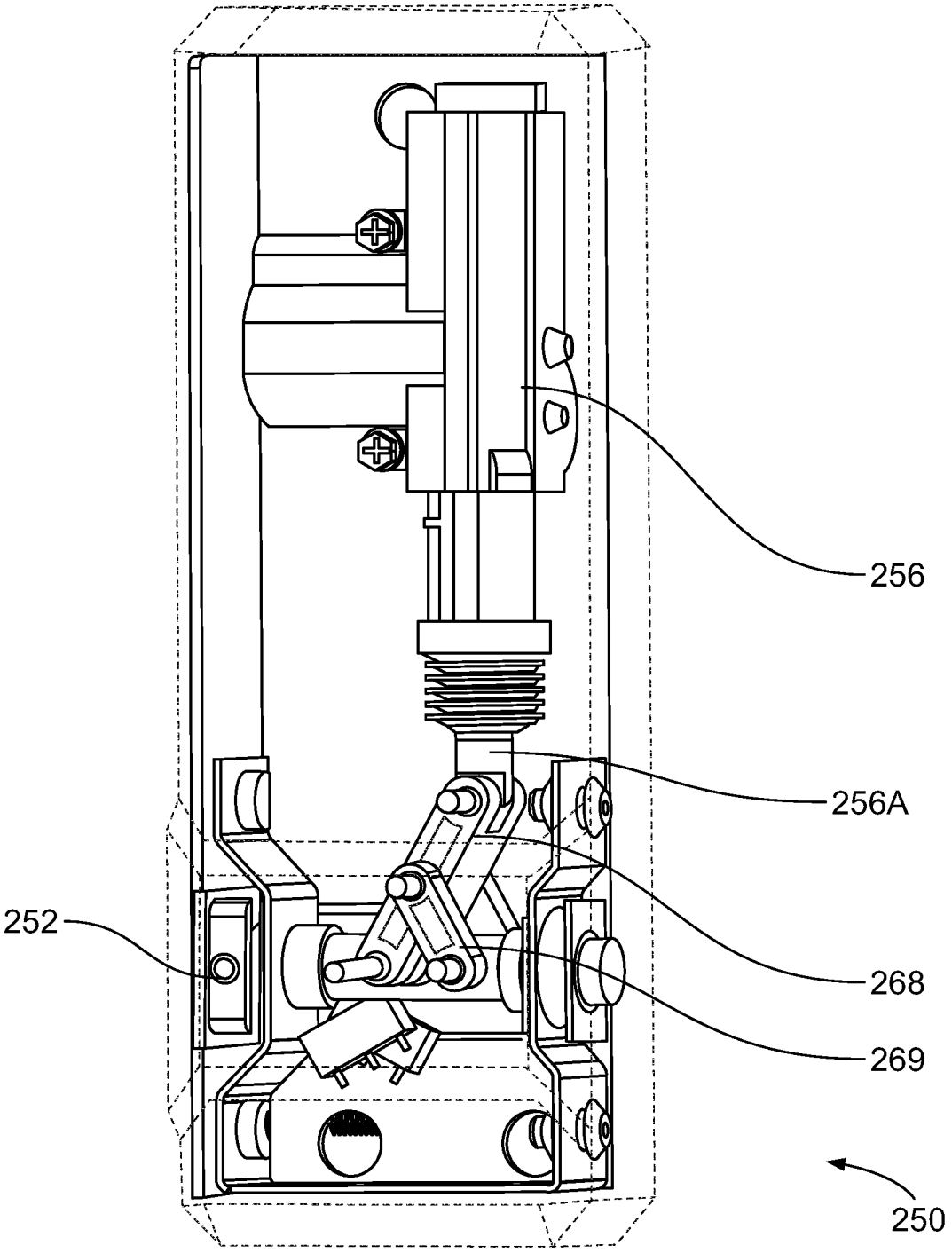
FIG. 5B is a perspective view of the lock of FIG. 5A with a housing of the lock transparent to show internal components of the lock.

Another lock 250 is illustrated in FIGS. 5A-5B. The lock 250 includes a linear actuator 256. The linear actuator 256 is operatively coupled to the bolt 252 by a linkage including links 268, 269. The links 268, 269 are pivotably connected such that they convert the vertical movement of a piston 256A of the actuator 256 into horizontal movement of the bolt 252. One end of the link 268 is coupled to the bolt 252, such that the vertical movement of the piston 256A actuates the bolt 252 between an extended locked position and a retracted unlocked position.

Figure 6:
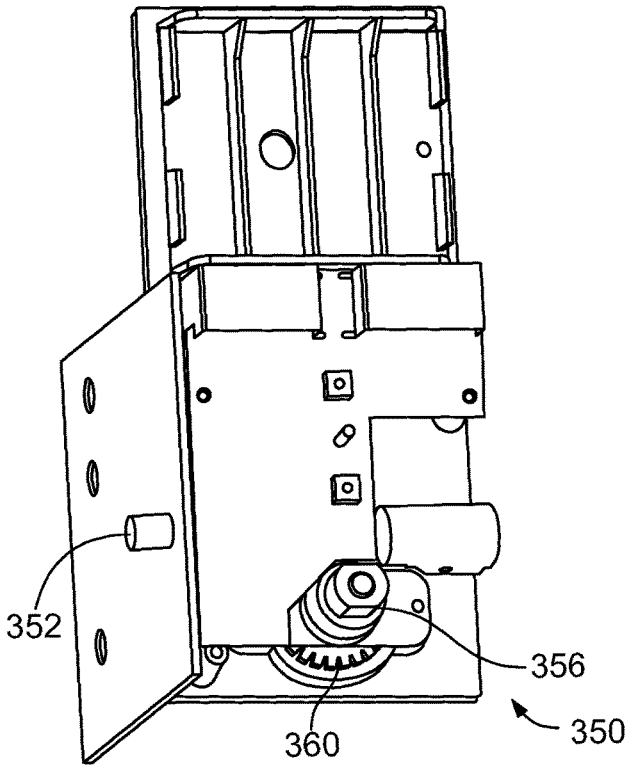
FIG. 6 is a perspective view of internal components of a passageway door lock.

The passageway door lock 350, as shown in FIG. 6, includes a motor 356 configured to rotate a slip clutch 360. The slip clutch 360 is operatively coupled to a bolt 352 such that rotation of the slip clutch 360 moves the bolt 352 between locked and unlocked positions. The bolt 352 has a cylindrical shape with rounded edges. The rounded shape of the bolt 352 decreases the likelihood of scratching the paint or finish of a door.

Figure 7:
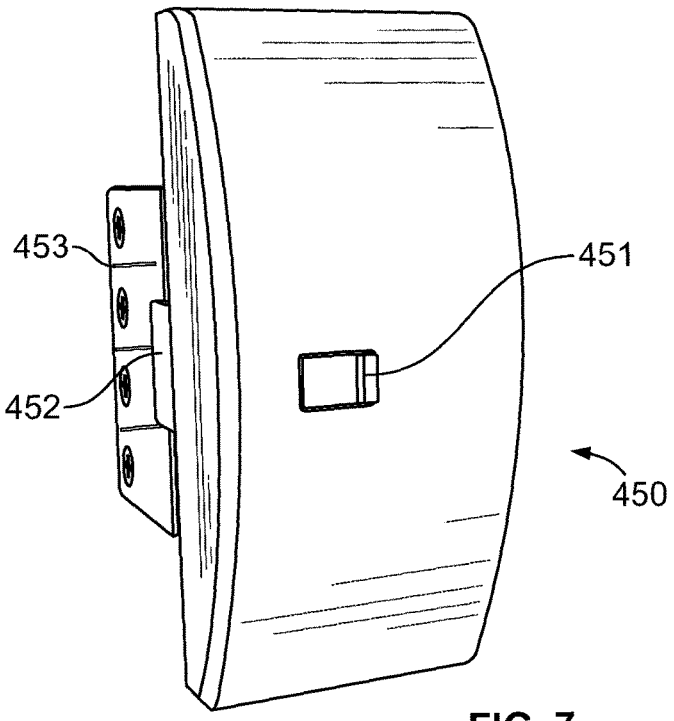
FIG. 7 is a perspective view of a passageway door lock.

FIG. 7 illustrates a passageway door lock 450 having a bolt 452 operatively coupled to a manual actuator 451. The lock 450 includes a slip clutch, such as the magnetic slip clutch 160 described above, allowing the bolt 452 to be manually actuated without damaging a drive motor of the lock 450. The lock 450 includes a mounting plate 453 having predetermined locations for receiving screws for mounting the lock 450 adjacent to a door.

Figure 8:
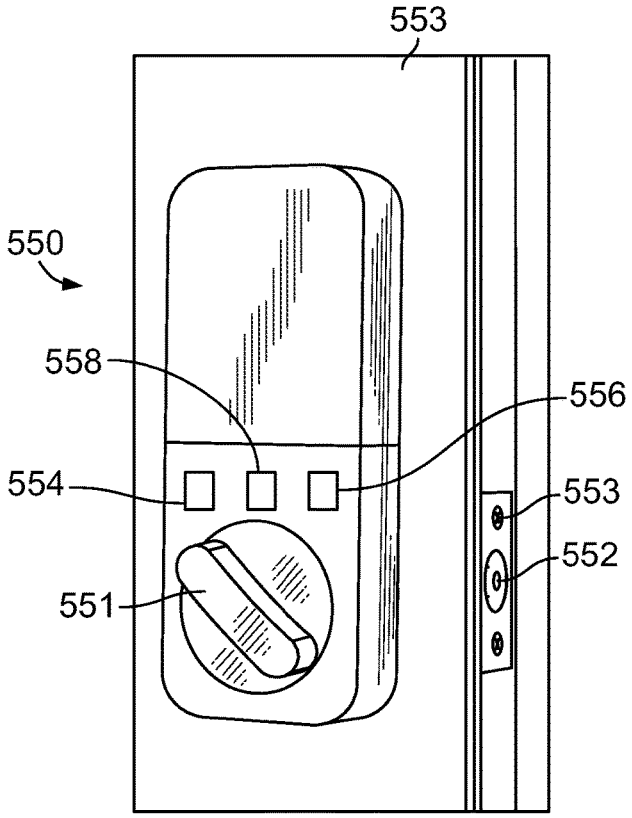
FIG. 8 is a perspective view of a passageway door lock of a passageway door with a bolt of the passageway door lock located within the door.

FIG. 8 illustrates a passageway door lock 550 of a door 553. As shown, the door lock 550 is configured to adapt or augment an existing deadbolt-type lock by coupling with or replacing a portion of the deadbolt-type lock, particularly an indoor mechanism. For instance, an indoor-accessible mechanism of a deadbolt lock such as a thumbturn or a keyed cylinder (of a double cylinder deadbolt) may be removed and replaced with the door lock 550 such that the remaining portions of the existing deadbolt lock (e.g., the keyed outdoor cylinder and the latch/bolt) couple and function with the door lock 550. Installation of the door lock 550 may entail replacement of a bolt 552, however the bolt 552 may be a portion of the existing deadbolt-type lock that remains independent of installation of the door lock 550. Bolt 552 is operatively coupled to a manual actuator 551 illustrated as a thumbturn. The bolt 552 is located within the door when in a retracted state. When actuated, the bolt 552 extends from the door and enters a cavity in the door frame, as in traditional deadbolt locks. The passageway door lock 550 includes a wireless communication circuit 554 for receiving signals to control the actuation of the bolt 552. When the wireless communication circuit 554 receives a signal, the signal is transmitted to a controller 558 which operates a motor 556 to move the bolt 552. The controller 558 may include a processor and a memory. The passageway door lock 550 further includes a power source, such as one or more batteries. The bolt 552 extends through an opening of a plate 553. Passageway door locks 150, 250, 350, 450, and 550 operate in a manner similar to the passageway door lock 50 and may be utilized in the system 100.

Figure 9:
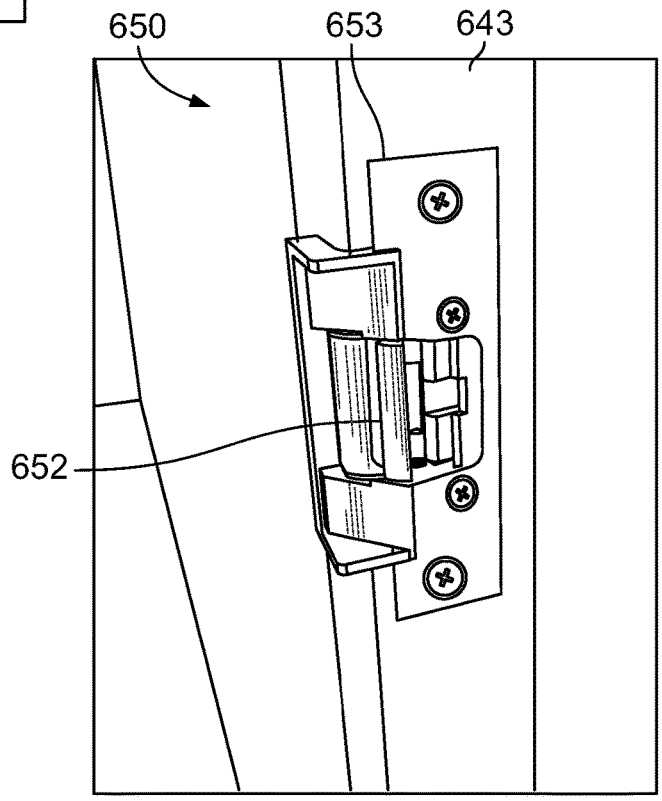
FIG. 9 is a perspective view of an electric strike for a passageway door.

In some forms, locks other than deadbolts may be used in the system 100 to secure the passageway door. FIG. 9 illustrates an electric strike 650 for securing a passageway door, such as the passageway door 49 of FIG. 1. The electric strike 650 includes a mounting plate or strike plate 653 for mounting the electric strike 650 to the door jamb 643. A movable keeper or latchbar 652 is configured to releasably secure the passageway door in a closed position. The latchbar 652 is actuated to move from the secured position, as shown in FIG. 9, to an unsecured position in order to release the passageway door. The electric strike contains an internal power source, motor or actuator, and wireless receiver similar to those described in the embodiments above.

As with the locks described above, the electric strike 650 is remotely controlled by at least one of the movable barrier operator 12 or a remote device, such as a server computer or a wireless device via the internet. In operation, a control signal is transmitted to the electric strike 650 which causes the electric strike 650 to move the latchbar 652 into the secured or unsecured position.

Other types of locks may be used in the system 100. For example, a lock that fits over a thumb turn of an existing, conventional deadbolt lock to operate the deadbolt may be utilized. As another example, a lock that replaces an interior-side thumb turn of a conventional deadbolt lock while keeping the internal deadbolt mechanism and exterior keyed cylinder may be utilized.

A user or administrator grants access to the garage 14 by giving out temporary or limited access codes. In some forms, the limited access code is in the form of a code to be entered into the keypad 34. In another form, the limited access code is programmed into a portable transmitter 30, 31 or the wireless device 61. In yet another form, the limited access code is programmed into the movable barrier operator 12 in addition to programming the limited access code (or a complementary code) into a portable transmitter 30, 31 or the wireless device 61. In other instances a remote resource 62 (e.g., server computer) transmits or otherwise communicates the limited access code to a portable transmitter 30, 31 or the wireless device 61 upon request after performance of a security measure such as at least one of verification, authorization and authentication of the requester. The wireless device 61 communicates with the remote resource 62, which may be a server computer or a plurality of server computers forming a cloud, which in turn communicates with the moveable barrier operator 12 via the local gateway 60. A limited access code may be one or more codes output from a rolling code encryption process used by the moveable barrier operator 12. Accordingly, the movable barrier operator 12 may provide the remote resource 62 with a rolling code that is generated or output based on a query or request such that the rolling code can be relayed to a portable transmitter 30, 31 or the wireless device 61 for example after performance of a security measure.

The moveable barrier operator 12 includes memory (e.g., integral/unitary or otherwise onboard the controller 13 in FIG. 3 or separate/distinct from the controller 13) storing the limited access codes and associating them with specific permissions. In some forms, the permissions limit the times of day and/or days during which the moveable barrier operator 12 will open the garage door 24 in response to receiving the limited access codes. The permissions also indicate whether or not the code grants access to the attached home or structure via the passageway door 49. The operation of the lock 50 and permission to open the door 49 can differ from whether a guest has permission to open the garage door 24. For example, some codes used to enter the garage door 24 can have stored permissions to permit entry into both the garage and the house, in which case the garage door 24 will open and the lock 50 will unlock. Other codes will have stored permissions limited to the garage, in which case the garage door 24 will open and the lock 50 will lock. In operation, a user having administrator rights may establish and/or provide access codes granting only garage access permission to delivery associates such that they can leave packages in the garage 14. Different access codes may be established and/or given to maids, contractors, guests, or others to control when such individuals are permitted to enter the garage 14 and whether the guest can open the door 49 to the adjacent area.

As described above, the moveable barrier operator 12 receives a signal and checks a code of the signal against a stored table of permissions. If the code grants permission to enter the garage 14 and the home, the movable barrier operator 12 or remote resource 62 transmits an unlock signal to the lock 50 at the passageway door 49 and the movable barrier operator 12 opens the garage door 22. If permission to enter the home is not granted but the guest can access the garage 14, the movable barrier operator 12 or remote resource 62 transmits a lock signal to the lock 50 and the movable barrier operator 12 opens the garage 14.

In addition to the limited access codes, the administrator or another user can create primary codes, such as permanent or resident access codes. The resident access codes can be used at any time and any number of times. When the moveable barrier operator 12 receives a resident access code, the movable barrier operator 12 transmits an unlock signal or causes remote resource 62 to transmit the unlock signal to the lock 50. These resident access codes can later be changed or revoked by the administrator.

The moveable barrier operator 12 may use additional data when determining whether or not to transmit a lock signal (or cause the lock signal to be transmitted e.g., from the remote resource 62) to the lock 50. In one example, the movable barrier operator 12 transmits a lock signal to the lock 50 if no users are at home, if only a single resident is at home, or if only children are at home, but not if adults are at home. The system 100 detects who is at home by, for example, tracking codes entered at the keypad 34, detecting vehicles in the garage 14, and/or identifying wireless devices communicatively coupled to the gateway 60 and/or the movable barrier operator 12. For example, the system 100 may store identifying information of the smartphones of the adults that live in the home. If those smartphones are connected to the gateway 60, they are identified by the movable barrier operator 12 and/or the remote resource 62, and the movable barrier operator 12 does not lock the passageway door lock 50. In alternative forms, the administrator or another user enters schedule information into an application running on her smartphone which is provided to a home automation system associated with the garage 14 and/or the movable barrier operator 12. The schedule information indicates the standard schedule of the users. The movable barrier operator 12 or the remote resource 62 will operate the lock 50 based on whether or not the adults should be home according to the preprogrammed schedule.

In some embodiments, the lock 50 includes one or more sensors configured to detect the position of the bolt 52. The position of the bolt 52 is transmitted to the moveable barrier operator 12 or the remote resource 62 by the lock 50. If the bolt 52 is already in the locked position, the movable barrier operator 12 or the remote resource 62 may not transmit a lock command. The sensor detects when the bolt 52 is actuated. In some forms, the moveable barrier operator 12 creates a log storing times at which the bolt 52 is actuated. This log can be accessed by the administrator or another user. Alternatively or additionally, a signal is transmitted to the wireless device 61 of the administrator when the bolt 52 is actuated. The moveable barrier operator 12 may store a log of received signals from transmitters 30, 31. The log includes identifying information associated with the transmitters 30, 31 and/or access codes and the time at which signals were received. In some forms, the log further includes the time at which a close signal was received at the moveable barrier operator 12 and/or the amount of time between the open and close signal.

In operation, each of the door locks 50-650 illustrated in FIGS. 2-9 and described above are controlled in substantially the same manner. A remote control transmits a control signal. The remote control may be a short range transmitter transmitting a signal directly to the movable barrier operator 12 or an internet connected wireless device sending a signal via the internet as some examples. The control signal is authenticated to determine if the remote control is associated with a first level of access or a second level of access. In response to the control signal being associated with a first level of access, the movable barrier operator 12 and passageway door lock 50-650 are operated to open and/or unlock the first barrier 24 and second barrier 49 respectively. In response to the control signal associated with a second level of access, the movable barrier operator 12 is operated to open the first barrier 24 and the passageway door lock 50-650 is operated to secure or lock the second barrier 49.

In some forms, the authentication is performed by the movable barrier operator 12. The movable barrier operator 12 receives the control signal transmitted by the remote control or receives a signal representing the control signal from an intermediate device, such as a server computer, and processes the received signal to determine the level of access. The moveable barrier operator 12 moves the first barrier 24 and transmits an actuation signal to the door lock 50-650 to lock or unlock based on the level of access associated with the signal as described above.

In alternative forms, a device separate from the movable barrier operator 12 authenticates the control signal. For example, an onsite communication hub or a remote server device authenticate the signal to determine the level of access. The authenticating device may then transmit an actuation signal to the movable barrier operator 12 and door lock 50-650 to operate the barriers 24, 49 as described above.

In still further forms, the movable barrier operator 12 authenticates the signal before moving the first barrier 12 and a separate device, such as the door lock 50-650, on site communication hub, or remote server device, separately authenticates the signal in order to determine the appropriate actuation of the door lock 50-650.

In some embodiments, additional devices, such as the indicator 19 or camera 17 are operated in response to the authentication of the signal. For example, the camera 17 is used to record data, such as images or video, in response to the control signal being a secondary signal (i.e., being associated with the second level of access) and/or the indicator 19 is operated to indicate a dropoff area in response to the control signal being a secondary signal.

Although method steps may be presented and described herein in a sequential fashion, one or more of the steps shown and described may be omitted, repeated, performed concurrently, and/or performed in a different order than the order shown in the figures and/or described herein. It will be appreciated that computer-readable instructions for facilitating the methods described above may be stored in various non-transitory computer readable mediums as is known in the art. Those skilled in the art will recognize that a wide variety of modifications, alterations, and combinations can be made with respect to the above described examples without departing from the scope of the invention, and that such modifications, alterations, and combinations are to be viewed as being within the ambit of the inventive concept.

What is claimed is:

1. A movable barrier operator comprising:

a motor configured to be coupled to a movable barrier to move the movable barrier;

communication circuitry configured to receive a control signal and communicate with a door lock associated with a passageway door;

a controller operatively coupled to the motor and the communication circuitry, the controller configured to authenticate the control signal, wherein authentication of the control signal includes determining an association of the control signal with a first level of access or a second level of access;

an indicator operably coupled to the controller, the indicator configured to provide a parking indication in response to the controller determining that the control signal is associated with the first level of access, the indicator further configured to provide a delivery indication different from the parking indication in response to the controller determining that the control signal is associated with the second level of access;

the controller further configured to communicate with the door lock via the communication circuitry to cause unlocking of the door lock and permit opening of the passageway door in response to determining that the control signal is associated with the first level of access, and to cause locking of the door lock and inhibit opening of the passageway door in response to determining that the control signal is associated with the second level of access; and wherein the controller is configured to cause the motor, in response to the authentication and upon causing the unlocking or the locking of the door lock, to open the movable barrier regardless of association of the control signal with the first level of access or the second level of access.

2. The movable barrier operator of claim 1 further comprising a camera operably coupled to the controller, the controller further configured to operate the camera to record an image and/or a video in response to determining that the control signal is associated with the second level of access, the controller further configured to not operate the camera in response to determining that the control signal is associated with the first level of access.

3. The movable barrier operator of claim 1 wherein the indicator includes at least one of a light and a laser to provide the parking indication and the delivery indication; and wherein the indicator includes a motor configured to move the at least one of the light and laser from a first orientation to provide the parking indication in a first location and a second orientation to provide to the delivery indication at a second location different from the first location.

4. The movable barrier operator of claim 1 wherein the controller is further configured to cause the motor to move the movable barrier a first distance in response to the controller determining that the control signal is associated with the first level of access, the controller further configured to cause the motor to move the movable barrier a second distance less than the first distance in response to the controller determining that the control signal is associated with the second level of access.

5. The movable barrier operator of claim 1 further comprising a memory operatively coupled to the controller and configured to store information regarding whether the door lock is in a locked state or an unlocked state, wherein the controller is further configured to:

permit opening of the passageway door in response to determining that the control signal is associated with the first level of access by keeping the door lock in the unlocked state if the door lock is in the unlocked state and changing the door lock to the unlocked state if the door lock is in the locked state; and inhibit opening of the passageway door in response to determining that the control signal is associated with the second level of access by keeping the door lock in the locked state if the door lock is in the locked state and changing the door lock to the locked state if the door lock is in the unlocked state.

6. The movable barrier operator of claim 1, wherein the communication circuitry is configured to receive the control signal and communicate, via a remote resource, with the door lock associated with the passageway door.

7. The movable barrier operator of claim 1, wherein the movable barrier operator includes the indicator.

8. The movable barrier operator of claim 1, wherein the controller is configured to cause operation of the indicator upon authentication of the control signal.

9. The movable barrier operator of claim 1, wherein the controller is configured to cause the indicator to move the delivery indication upon receiving a user input indicating a different selected delivery location via the communication circuitry.

10. A method of controlling access to a secured area having a movable barrier and a passageway door, the method comprising:

receiving a control signal with information that associates the control signal with a first level of access or a second level of access;

determining an association of the control signal with the first level of access or the second level of access;

selectively controlling movement of the passageway door, wherein selectively controlling includes unlocking a door lock of the passageway door and permitting opening of the passageway door in response to determining that the control signal is associated with the first level of access and locking the door lock of the passageway door and inhibiting opening of the passageway door in response to determining that the control signal is associated with the second level of access;

operating an indicator to provide a parking indication in response to determining that the control signal is associated with the first level of access, and provide a delivery indication different from the parking indication in response to determining that the control signal is associated with the second level of access; and operating a movable barrier operator to open the movable barrier upon causing the unlocking or the locking of the door lock in response to determining that the control signal is associated with either the first access level or the second access level.

11. The method of claim 10 further comprising operating a camera to record at least a portion of the secured area in response to determining that the control signal is associated with the second level of access, and not operating the camera in response to determining that the control signal is associated with the first level of access.

12. The method of claim 10 wherein operating the movable barrier operator comprises moving the movable barrier a first distance in response to determining that the control signal is associated with the first level of access and opening the movable barrier a second distance less than the first distance in response to determining that the signal is associated with the second level of access.

13. The method of claim 10 further comprising determining whether the door lock of the passageway door is in a locked state or an unlocked state;

wherein permitting opening of the passageway door includes allowing the door lock to remain in the unlocked state if the door lock is in the unlocked state or changing the door lock to the unlocked state if the door lock is in the locked state; and wherein inhibiting opening of the passageway door includes allowing the door lock to remain in the locked state if the door lock is in the locked state or changing the door lock to the locked state if the door lock is in the unlocked state.

14. A system for controlling access to a secured area, the system comprising:

a movable barrier operator coupled to a movable barrier;

a door lock of a passageway door;

an indicator; and a portable electronic device communicatively coupled to the movable barrier operator and associated with either a first level of access or a second level of access to the secured area, the portable electronic device configured to communicate a control signal to the movable barrier operator to cause the movable barrier operator to open the movable barrier;

wherein the indicator is configured to provide a parking indication in response to communication of the control signal from the portable electronic device and determination that the portable electronic device is associated with the first level of access, the indicator further configured to output a delivery indication different from the parking indication in response to communication of the control signal from the portable electronic device and determination that the portable electronic device is associated with the second level of access;

wherein the door lock is configured to unlock and permit opening of the passageway door in response to communication of the control signal from the portable electronic device and determination that the portable electronic device is associated with the first level of access;

the door lock further configured to lock and inhibit opening of the passageway door in response to communication of the control signal from the portable electronic device and determination that the portable electronic device is associated with the second level of access.

15. The system of claim 14 further comprising a server computer configured to receive the control signal from the portable electronic device and communicate an actuation signal to the movable barrier operator or the door lock.

16. The system of claim 15 wherein the server computer is configured to determine if the portable electronic device is associated with either the first level of access or the second level of access.

17. The system of claim 15, wherein the server computer is configured to communicate the actuation signal to the movable barrier operator, and the movable barrier operator is configured to transmit a second actuation signal to the door lock in response to receiving the actuation signal, the second actuation signal configured to cause the door lock to lock or unlock.

18. The system of claim 14 further comprising a camera configured to record an image and/or a video in response to the determination that the portable electronic device is associated with the second level of access.

19. The system of claim 14 further comprising a motor of the indicator configured to reconfigure the indicator between a first orientation associated with the parking indication and a second orientation associated with the delivery indication.

20. The system of claim 14 wherein the control signal includes information indicating whether the portable electronic device is associated with the first level of access or the second level of access.

* * * * *